US006123527A

United States Patent [19]

Kawada et al.

[11] Patent Number: 6,123,527

[45] Date of Patent: Sep. 26, 2000

[54] SCROLL HYDRAULIC MACHINE

[75] Inventors: Minoru Kawada; Shigeki Miura, both of Nishi-kasugai-gun, Japan

[73] Assignee: Mitsubishi Heavy Industries, Ltd., Tokyo, Japan

[21] Appl. No.: 09/009,305

[22] Filed: Jan. 20, 1998

[30] Foreign Application Priority Data

Jan. 23, 1997 [JP] Japan ..... 9-023101

[51] Int. Cl.[7] ..... F01C 1/02

[52] U.S. Cl. ..... 418/55.1; 418/151

[58] Field of Search ..... 418/151, 55.1

[56] References Cited

U.S. PATENT DOCUMENTS

| | | | |
|---|---|---|---|
| 5,362,218 | 11/1994 | Fukanuma et al. | 418/55.5 |
| 5,460,494 | 10/1995 | Lee | 418/55.5 |
| 5,597,297 | 1/1997 | Yamamoto et al. | 418/55.1 |
| 5,947,709 | 9/1999 | Koyama et al. | 418/55.6 |

FOREIGN PATENT DOCUMENTS

| | | | |
|---|---|---|---|
| 0 236 665 | 9/1987 | European Pat. Off. . | |
| 236665 | 9/1987 | European Pat. Off. | 418/151 |
| 13789 | 1/1985 | Japan | 418/151 |
| 73078 | 4/1985 | Japan | 418/151 |
| 149384 | 6/1991 | Japan | 418/55.3 |

OTHER PUBLICATIONS

Patent Abstracts of Japan, vol. 11, No. 188 (M–599), Jun. 17, 1987, JP 62–013789, Jan. 22, 1987.

*Primary Examiner*—Thomas Denion
*Assistant Examiner*—Theresa Trieu
*Attorney, Agent, or Firm*—Oblon, Spivak, McClelland, Maier & Neustadt, P.C.

[57] ABSTRACT

A scroll hydraulic machine has a fixed scroll and a swirling scroll performing a revolutionary swirling motion while engaging with the fixed scroll; there is also a balance weight in which a distance between a center of revolution of the swirling scroll and the center of gravity of the balance weight is changed in response to rotational speed of the swirling scroll.

3 Claims, 3 Drawing Sheets

10 ; FIXED SCROLL
14 ; SWIRLING SCROLL
21 ; DRIVE BUSH
24 ; SLIDE GROOVE
40 ; BALANCE WEIGHT

21 ; DRIVE BUSH
24 ; SLIDE GROOVE
40 ; BALANCE WEIGHT
40A ; FIXED BALANCE WEIGHT
40B ; MOVABLE BALANCE WEIGHT
41 ; RECEESS PORTION
42 ; THROUGH HOLE
43 ; ROD
44 ; ABSORBING MEMBER
45 ; ELASTIC MEMBER

21 : DRIVE BUSH
24 : SLIDE GROOVE
40 : BALANCE WEIGHT
40A : FIXED BALANCE WEIGHT
40B : MOVABLE BALANCE WEIGHT
41 : RECEESS PORTION
42 : THROUGH HOLE
43 : ROD
44 : ABSORBING MEMBER
45 : ELASTIC MEMBER

SCROLL HYDRAULIC MACHINE

BACKGROUND OF THE INVENTION

1. Field of the Invention

The present invention relates to a scroll hydraulic machine used as a compressor or an expansion device. The present application is based on Japanese Patent Application No. 9-23101, the contents of which are herein incorporated by reference.

2. Description of the Related Art

To a hydraulic machine having a fixed scroll and a swirling scroll engaging with the fixed scroll and performing a swirling motion, there is mounted a balance weight for balancing a dynamic imbalance due to a revolutionary swirling motion of the swirling scroll.

FIG. 4 is a front elevational view of a conventional balance weight 27 and a cross sectional view along a line B—B in FIG. 4 as shown in FIG. 5. The balance weight 27 has a semicircular plate shape and is mounted to an outer periphery of a drive bush 21 rotating integrally with a rotating shaft (not shown).

In the conventional scroll hydraulic machine mentioned above, a centrifugal force acted on the swirling scroll and the balance weight is expressed by the following equation:

$$\text{Centrifugal force}=(M_O-M_B)\cdot\rho\cdot\omega^2$$

in which $M_O$ is a mass of the swirling scroll, $M_B$ is a mass of the balance weight, $\rho$ is a radius of a revolutionary swirling of the swirling scroll and $\omega$ is a rotational angular velocity of the swirling scroll.

Since the centrifugal force is small when the swirling scroll is rotating at a low speed, a force for bringing a spiral wrap of the swirling scroll into contact with a spiral wrap of the fixed scroll becomes small, so that there has been a problem in an amount of gas leaking from an inner portion of a compression chamber.

Further, since the centrifugal force becomes large when the swirling scroll is rotating at a high speed, a force for bringing the spiral wrap of the swirling scroll into contact with the spiral wrap of the fixed scroll becomes excessive, so that there has been a risk that these spiral wraps would be broken.

SUMMARY OF THE INVENTION

An object of the present invention is to provide a scroll hydraulic machine which is constructed such that, when the swirling scroll is operated at a low rotational speed, a force for bringing a spiral wrap of the swirling scroll into contact with a spiral wrap of a fixed scroll is increased so as to reduce an amount of a fluid leaking from a gap therebetween, and further when the swirling scroll is operated at a high rotational speed, a force bringing the spiral wrap of the swirling scroll into contact with the swirling wrap of the fixed scroll is reduced so as to prevent these spiral wraps from being broken.

In order to solve the above problems, in accordance with the present invention, there is provided a scroll hydraulic machine comprising a fixed scroll, a swirling scroll performing a revolutionary swirling motion while engaging with the fixed scroll, and a balance weight in which a distance between a center of a revolution of the swirling scroll and the center of gravity of the balance weight is changed in response to a rotational speed of the swirling scroll.

In accordance with the present invention, since the balance weight is structured such that the distance between the center of revolution of the swirling scroll and the center of gravity of the balance weight is changed in response to the rotational speed of the swirling scroll, the centrifugal force due to the balance weight can be set in response to the rotational speed of the swirling scroll. Accordingly, the dynamic imbalance due to the revolutionary swirling motion of the swirling scroll can be balanced from a low speed range to a high speed range.

In order to change the distance between the center of revolution of the swirling scroll and the center of gravity of the balance weight in response to the rotational speed of the swirling scroll, it is necessary to move all or a part of the balance weight in a radial direction of the revolutionary swirling of the swirling scroll. In order to move a part of the balance weight in the radial direction of the revolutionary swirling of the swirling scroll, it is necessary to constitute the balance weight in such a manner as to comprise a fixed balance weight, a movable balance weight provided in the fixed balance weight and capable of moving in the radial direction of the revolutionary swirling, and a resilient member pressing the movable balance weight toward the center of the revolution of the swirling scroll.

The balance weight is provided at a position in which the center of gravity thereof and the center of gravity of the swirling scroll form a point of symmetry with respect to the center of the revolution of the swirling scroll.

DESCRIPTION OF THE PREFERRED EMBODIMENT

The present invention will be described below on the basis of an embodiment.

Figure 1:
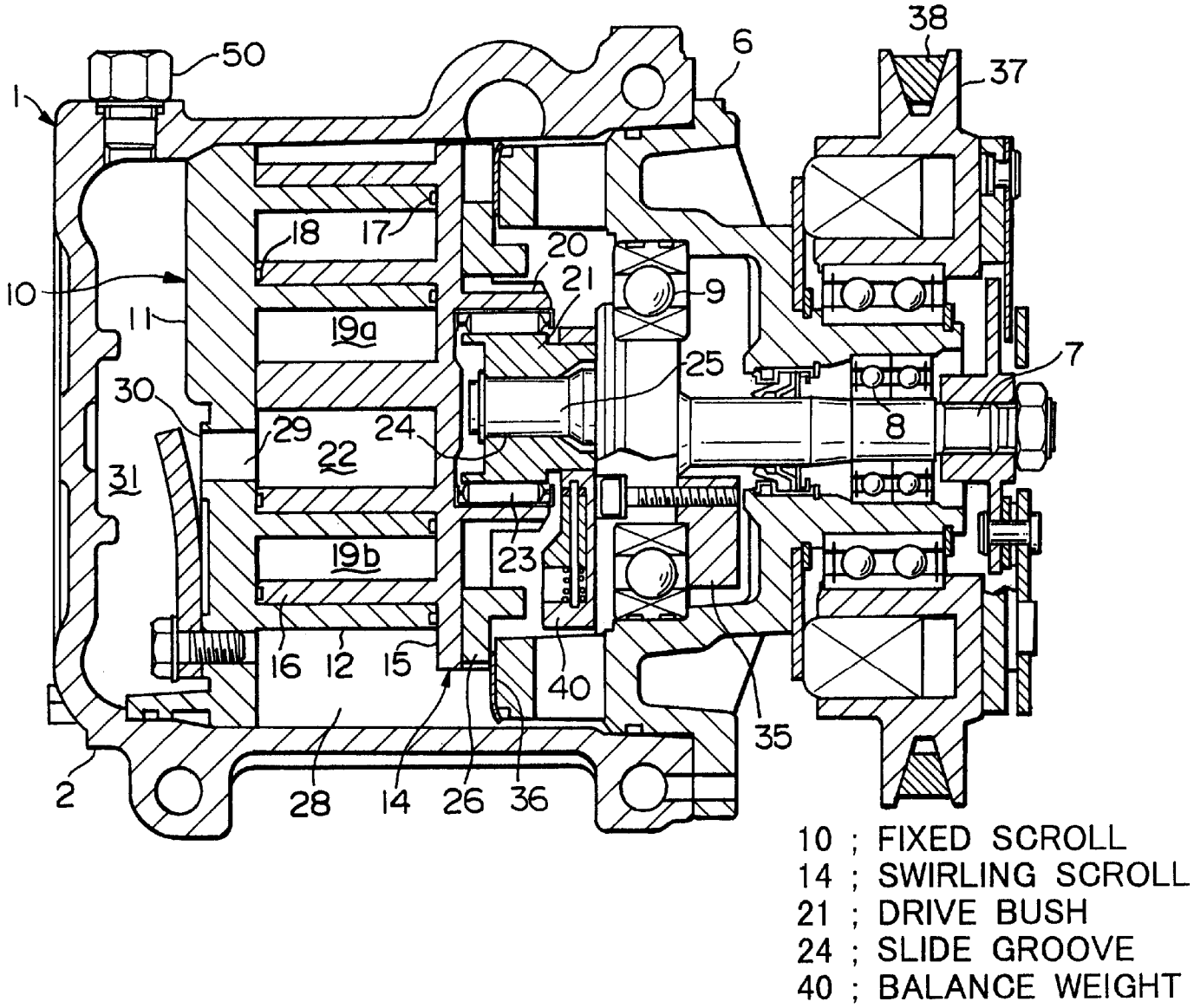
FIG. 1 is a vertical cross sectional view which shows a scroll compressor in accordance with an embodiment of the present invention.
Figure 2:
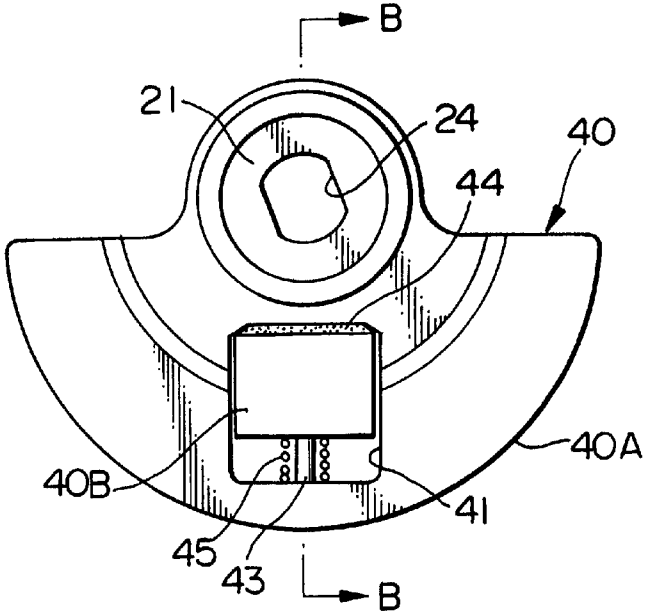
FIG. 2 is a front elevational view which shows a balance weight in accordance with the embodiment of the present invention.
Figure 3:
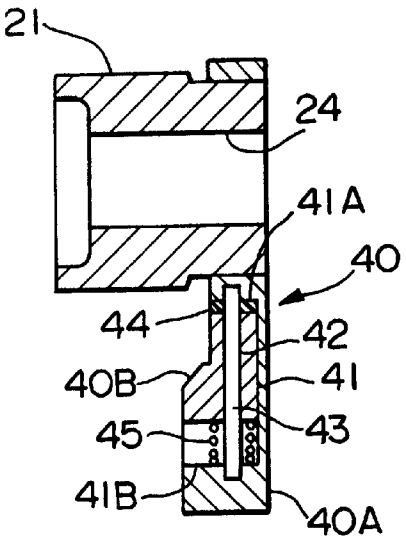
FIG. 3 is a cross sectional view which shows the balance weight in accordance with the embodiment of the present invention.
Figure 4:
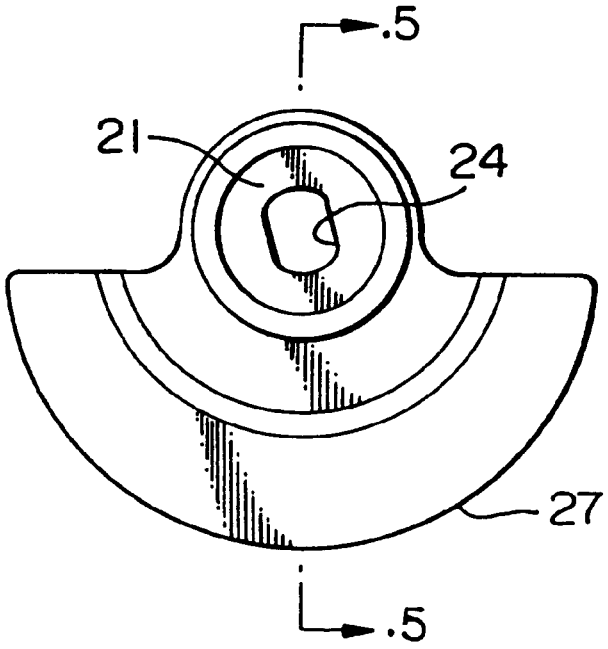
FIG.4 PRIOR ART
FIG. 4 is a front elevational view which shows a balance weight in accordance with the conventional art.
Figure 5:
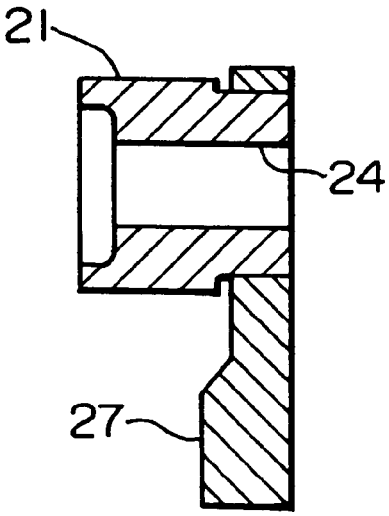
FIG.5 PRIOR ART
FIG. 5 is a cross sectional view which shows the balance weight in accordance with the conventional art.

FIG. 1 is a vertical cross sectional view of a scroll compressor in accordance with the present embodiment, FIG. 2 is a front elevational view of a balance weight in accordance with the present embodiment, and FIG. 3 is a cross sectional view along line B—B in FIG. 2.

In FIG. 1, a sealed housing 1 is constituted by a cup-shaped body 2 and a cylindrical member 6 fastened to the cup-shaped body 2 by a bolt (not shown).

A rotating shaft 7 extending through the cylindrical member 6 is rotatably supported at the sealed housing 1 through bearings 8 and 9.

A fixed scroll 10 and a swirling scroll 14 are disposed within the sealed housing 1.

The fixed scroll 10 is provided with an end plate 11 and a spiral wrap 12 disposed in an inner surface thereof in a standing manner, and the end plate 11 is fastened to the cup-shaped body 2 by a bolt (not shown).

A space within the sealed housing 1 is separated by bringing an outer peripheral surface of the end plate 11 into contact with an inner peripheral surface of the cup-shaped body 2, so that a high pressure chamber 31 is formed in an outer side of the end plate 11 and a low pressure chamber 28 is formed in an inner side of the end plate 11.

Further, a discharge port 29 pierces through a center of the end plate 11, and the discharge port 29 is structured in such a manner as to be opened and closed by a discharge valve 30.

The swirling scroll 14 is provided with an end plate 15 and a spiral wrap 16 disposed in an inner surface thereof in a standing manner. The spiral wrap 16 has substantially the same shape as that of the spiral wrap 12 of the fixed scroll 10.

The swirling scroll 14 and the fixed scroll 10 are engaged with each other in that the centers thereof are eccentrically by a swirling radius with respect to each other and the angles thereof are 180 degrees eccentrically shifted.

Accordingly, a tip seal 17 buried on a front end surface of the spiral wrap 12 is in close contact with the inner surface of the end plate 15 and a tip seal 18 buried on a front end surface of the spiral wrap 16 is in close contact with the inner surface of the end plate 11, so that the side surfaces of the spiral wraps 12 and 16 are in line contact at a plurality of portions, whereby compression chambers 19*a* and 19*b*, forming a point of symmetry with respect to the center of the spiral, are formed.

A drive bush 21 is rotatably fitted to an inner portion of a cylindrical boss 20 provided in a center portion on the outer surface of the end plate 15 in a projecting manner through a swirling bearing 23, and an eccentrically shifted drive pin 25 provided in the inner end of the rotating shaft 7 in such a manner as to have an eccentrically shifted center is slidably fitted within a slide groove 24 pierced in the drive bush 21.

Then, a balance weight 40 for balancing a dynamic imbalance due to a swirling motion of the swirling scroll 14 is mounted to the drive bush 21, as shown in FIG. 2.

In this case, a thrust bearing 36 is disposed between the peripheral edge of the outer surface of the end plate 15 and the peripheral edge of the inner surface of the cylindrical member 6. A rotation-preventing mechanism 26 allows a swirling motion of the swirling scroll 14, but prevents a rotation thereof. The mechanism 26 is an Oldham joint. A balance weight 35 is fixed to the rotating shaft 7. A relief valve 50 opens when a gas pressure within the high pressure chamber 31 is abnormally increased.

Accordingly, power from an automotive engine (not shown) is transmitted to the rotating shaft 7 through a belt 38 and a electromagnetic clutch 37 for a contact.

When the shaft 7 is rotated, the swirling scroll 14 is driven through a revolutionary swirling drive mechanism also serving as a swirling radius changing mechanism comprising the eccentrically shifted drive pin 25, the slide groove 24, the drive bush 21, the boss 20 and the like, so that the swirling scroll 14 performs a revolutionary swirling motion on a circular track having a swirling radius of the eccentrically shifted amount between the rotating shaft 7 and the eccentrically shifted drive pin 25 around the center of the revolution, that is, a line passing through an axial center of the rotating shaft 7 while the rotation thereof is prevented by the rotation preventing mechanism 26.

Then, the line contact portion between the side surfaces of the spiral wraps 12 and 16 gradually moves to a center direction of the spiral, and as a result, the compression chambers 19*a* and 19*b* move to the center direction of the spiral while reducing the volume thereof.

In correspondence, the gas flowed into the low pressure chamber 28 from an intake port (not shown) is introduced into the respective compression chambers 19*a* and 19*b* from an opening portion formed by the outer peripheral ends of the spiral wraps 12 and 16, is fed. The gas then the center chamber 22 while being compressed, is discharged to the high pressure chamber 31 therefrom through the discharge port 29 by pressing and opening a discharge valve 30, and next is flowed out through a discharge pipe (not shown).

At a time of the swirling motion of the swirling scroll 14, the centrifugal force toward the eccentrically shifted direction and the gas pressure due to the compression gas within the respective compression chambers 19*a* and 19*b* act on the swirling scroll 14, so that the swirling scroll 14 is pressed in the direction in which the swirling radius thereof increases due to the combined force thereof and the side surface of the spiral wrap 16 is in close contact with the side surface of the spiral wrap 12 of the fixed scroll 10 so as to prevent the gas within the compression chambers 19*a* and 19*b* from leaking.

Then, in correspondence with the side surface of the spiral wrap 12 and the side surface of the spiral wrap 16 in a state of being in close contact with each other, the swirling radius of the swirling scroll 14 automatically changes, so that the eccentrically shifted drive pin 25 slides within the slide groove 24.

The balance weight 40, which corresponds to a portion of the present invention, will be described below with reference to FIGS. 2 and 3.

The balance weight 40 is constituted by a fixed balance weight 40A fixedly attached to the drive bush 21 and a movable balance weight 40B, the center of gravity thereof is disposed in such a manner that the center of gravity thereof and the center of gravity of the swirling scroll form a point of symmetry with respect to the center of revolution of the swirling scroll, that is, a line passing through the axial center of the rotating shaft.

The movable balance weight 40B is received within a recess portion piercing into the fixed balance weight 40A.

A rod 43 is loosely fitted within a hole 42 piercing into the movable balance weight 40B and, extends in a radial direction. Both ends thereof are fixedly attached to the fixed balance weight 40A, respectively.

An absorbing member 44 made of rubber and the like is attached on the side surface 41A of the center of a recess portion 41, and an elastic member 45 such as a coil spring and the like is disposed between a radial side surface 41B of the recess portion 41 and the movable balance weight 40B.

When the swirling scroll performs a revolutionary swirling motion, the drive bush 21 and the balance weight 40 swirl in a revolutionary manner together therewith, so that the movable balance weight 40B is guided by the rod 43 due to the centrifugal force acting thereon, so as to move in the radial direction, and stops at a position in which the centrifugal force and the elastic force of the elastic member 45 are balanced with each other. Since the movable balance weight 40B moves to the radial direction in the above manner, the dynamic imbalance caused by the revolutionary swirling motion of the swirling scroll can be suitably balanced in response to the speed.

When the revolutionary swirling motion of the swirling scroll is stopped, the movable balance wight 40B is pressed and advanced by the elastic member 45 so as to move toward the center of the revolution, thereby colliding with the absorbing member 44. The collision sound at this time is prevented by the absorbing member 44.

In the above embodiment, the balance weight 40 is mounted to the drive bush 21; however, it may be mounted to a member performing a revolutionary swirling motion together with the swirling scroll, for example, the boss 20.

In accordance with the present invention, when the swirling scroll is operated at a low rotational speed, a force for bringing a spiral wrap of the swirling scroll into contact with a spiral wrap of a fixed scroll is increased so as to reduce an amount of fluid leaking from a gap therebetween, so that efficiency of the scroll hydraulic machine can be improved.

Further, when the swirling scroll is operated at a high rotational speed, a force bringing the spiral wrap of the swirling scroll into contact with the swirling wrap of the fixed scroll is reduced so as to prevent these spiral wraps from being broken.

What is claimed is:

1. A scroll hydraulic machine comprising:

a fixed scroll;

a swirling scroll performing a revolutionary swirling motion while engaging with the fixed scroll; and a balance weight in which a distance between a center of revolution of the swirling scroll and a center of gravity of the balance weight is changed in response to a rotational speed of the swirling scroll;

wherein said balance weight includes a fixed balance weight, a movable balance weight provided in the fixed balance weight and capable of moving in a radial direction of the revolutionary swirling motion, an absorbing member for preventing a collision sound when the movable balance weight is advanced towards the center of revolution of the swirling scroll, and a resilient member pressing the movable balance weight toward the center of revolution of the swirling scroll.

2. A scroll hydraulic machine as recited in claim 1, wherein the movable balance weight moves in the radial direction of the revolutionary swirling motion of the swirling scroll.

3. A scroll hydraulic machine as recited in claim 1, wherein the center of gravity of the balance weight and a center of gravity of the swirling scroll are disposed at a position forming a point of symmetry with respect to the center of revolution of the swirling scroll.

* * * * *